United States Patent [19]

Tuckey

[11] Patent Number: 4,715,777

[45] Date of Patent: Dec. 29, 1987

[54] LATERAL CHANNEL SUPPLY PUMP

[75] Inventor: Charles H. Tuckey, Cass City, Mich.

[73] Assignee: Walbro Corporation, Cass City, Mich.

[21] Appl. No.: 777,332

[22] Filed: Sep. 18, 1985

[51] Int. Cl.[4] ..... F04D 5/00

[52] U.S. Cl. ..... 415/53 T; 415/213 T

[58] Field of Search ..... 415/53 T, 198.2, 213 T, 415/140; 417/423 R, 366, 410

[56] References Cited

U.S. PATENT DOCUMENTS

| | | | |
|---|---|---|---|
| 2,015,200 | 9/1935 | Spoor | 415/213 T X |
| 3,658,444 | 4/1972 | Rhodes et al. | 415/213 T X |
| 3,771,927 | 11/1973 | Schiller | 415/140 |
| 3,947,149 | 3/1976 | MacManus | 415/213 T |

FOREIGN PATENT DOCUMENTS

| | | | |
|---|---|---|---|
| 1010524 | 6/1952 | France | 415/198.2 |
| 635312 | 8/1959 | Italy | 415/213 T |

*Primary Examiner*—Robert E. Garrett
*Assistant Examiner*—Joseph M. Pitko
*Attorney, Agent, or Firm*—Barnes, Kisselle, Raisch, Choate, Whittemore & Hulbert

[57] ABSTRACT

A lateral channel fuel pump wherein a multi-pocketed impeller rotates in face-to-face contact with a stationary pump face having arcuate passages including an inlet and outlet. fuel enters the inlet and is moved circumferentially such that pressure develops dynamically at the outlet. A sweep channel is designed to deepen at the outer radius to adjust to varying radial speeds of the rotor and a spill channel is provided radially outward of the inlet channel to receive fuel from the rotor and move it in part toward the outlet and in part back to the inlet to provide a smooth flow pattern.

8 Claims, 9 Drawing Figures

LATERAL CHANNEL SUPPLY PUMP

FIELD OF INVENTION

Electrically driven fuel supply pumps for automotive vehicles especially of the lateral channel type wherein an impeller with circumferentially distributed chambers rotates adjacent a channeled plate to move liquid fuel from an inlet to a pressure outlet.

BACKGROUND AND OBJECTS OF THE INVENTION

Fuel pumps utilizing the lateral channel principle are known in the field. These pumps utilize a stationary flat plate with a circumferentially extended groove or channel. A rotor having circumferentially radially extending pockets is positioned to rotate closely adjacent the stationary plate to move fuel from an inlet in the channel to an outlet from the channel with an increase in pressure taking place between the inlet and outlet.

Issued United States patents which disclose this type of lateral channel pump are:

| | | |
|---|---|---|
| Shultz et al | #3,418,991 | Dec. 31, 1968 |
| Bottcher et al | #3,836,291 | Sept. 17, 1974 |
| Nusser et al | #3,873,243 | Mar. 25, 1975 |
| Ruhl et al | #4,231,718 | Nov. 4, 1980 |

There is, of course, a constant effort to increase the efficiency of these pumps and it is an object of the present invention to provide a pump design of the lateral channel type which can be more efficient due to essentially zero clearance between stator and rotor and also a pump which varies very little in performance with temperature variations from cold to hot ambient and fuel temperatures.

A further object is the provision of an efficient channel pump which will effectively handle vaporized fuel and yet provide a pump which has excellent lift, pressure output and volume characteristics.

A further object of the present invention lies in a simplified mechanical construction with a stub shaft mount for both the stator and the rotor to insure minimal run-out and close rotary contact.

A still further object is the provision of a channel design in the stator which provides a two-stage function for fuel intake, vapor purge and pressure areas with a channel configuration which reduces turbulence and utilizes the centrifugal action of the fuel to enhance the efficiency.

Other objects and features of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figures 1, 2, 3, 4:
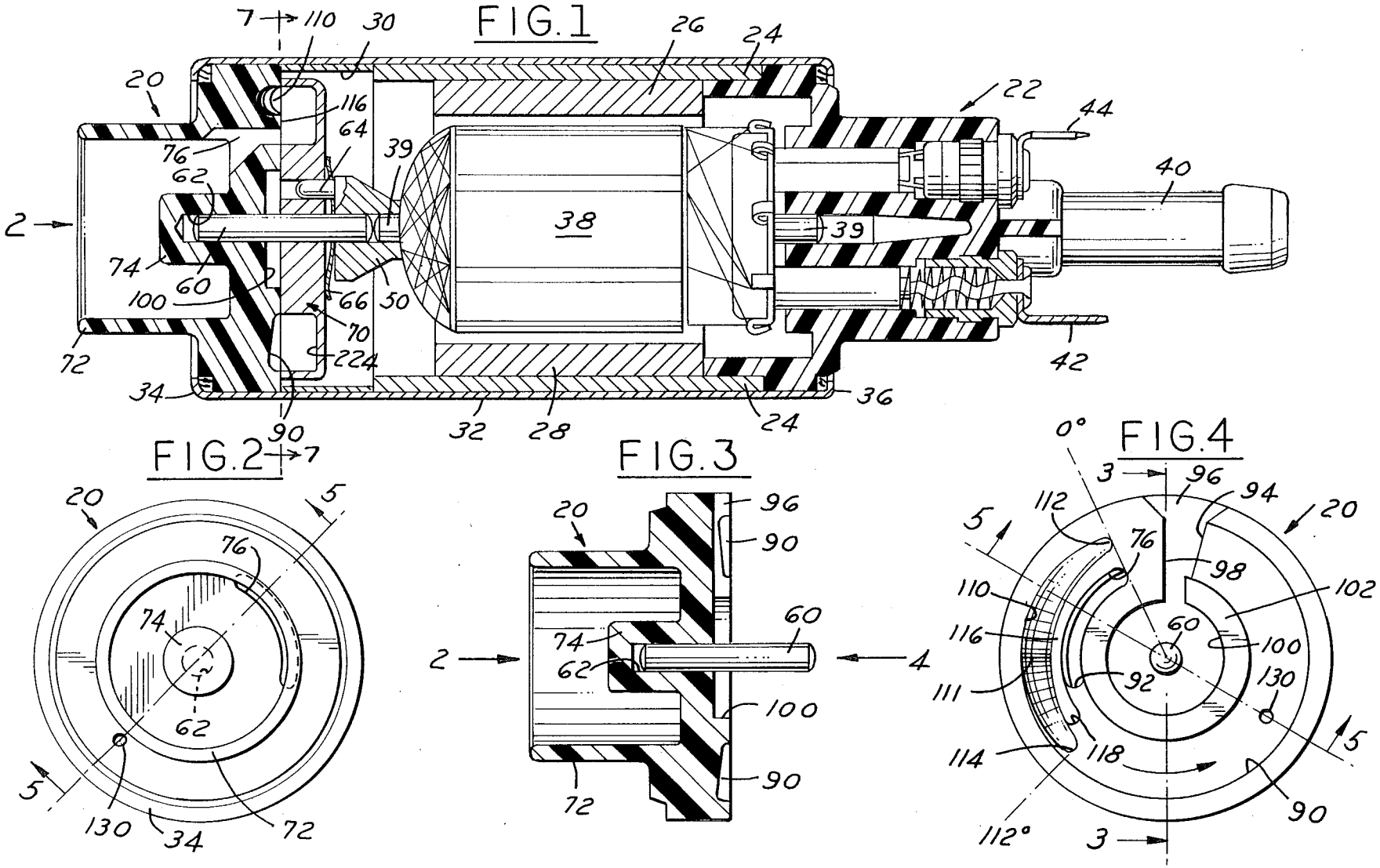
FIG. 1, a longitudinal section of a pump assembly.
FIG. 2, an end view of the inlet end of the pump from the left as viewed in FIG. 1 at arrow 2.
FIG. 3, a sectional view of the inlet housing taken on line 3—3 of FIG. 4.
FIG. 4, a sectional view of the inlet housing on line 4—4 of FIG. 1 in the orientation of FIG. 3.

In FIG. 1, a sectional view of a pump assembly is illustrated. This pump would normally be mounted vertically in a fuel tank with the inlet end at the left, as viewed in FIG. 1 at the lower end.

The pump is composed of an inlet housing 20, an outlet housing 22, a flux ring 24, electric motor arcuate magnets 26 and 28, a spacer ring 30, and a cylindrical shell container 32 spun in at each end 34 and 36 over sealing O-rings. An armature assembly 38 including a brush plate is mounted at one end in the outlet housing 22 by a central shaft 39. The outlet end also has brush recesses and an outlet nipple 40 for connection to a fuel line. Suitable brush terminals 42 and 44 are provided at the outlet housing 22. The inlet housing 20 and the outlet housing 22 are shown in the drawings as formed of molded plastic but one or both of these housings could be formed of metal as die castings or formed in other ways standard to the field.

The other end of the armature serves as the driving end and has a multi-fingered projections 50 non-rotatably secured to the armature assembly 38 and having a central bore journalled on a stub shaft 60 seated in a central bore 62 of inlet housing 20. The projection 50 has circumferentially spaced, axially extending fingers 64 which project into matching holes in a rotor 70 to be described in greater detail below. The rotor 70 is urged toward the working face of the housing 20 by a spider spring disc 66 having legs pressing against the rotor and a central portion backed by the armature projection 50. Thus, energization of the confined electric motor causes rotation of the armature assembly and the rotor 70.

The inlet housing 20 (FIGS. 1, 2 and 3) has an annular wall 72 surrounding a short protuberance 74 in which is the blind bore 62 mounting the stub shaft 60. An arcuate fuel inlet passage 76 leads from the space enclosed by wall 72 to the inner working face of the inlet housing 20 shown in elevation in FIG. 4.

This inner working face contains the critical recesses for the lateral channel pump. As viewed in FIG. 4, the rotation of the rotor 70 will be counterclockwise. A circumferential sweep channel 90 originates at the end 92 of the arcuate inlet port 76 and terminates at ledge 94 forming one side of an outlet passage 96. The other side of the outlet passage 96 is formed by a radial ledge 98. The ledge 94 has an angle of about 15° to the diameter on which the ledge 98 is located. Centrally of the working face is a circular pocket 100 surrounding the stationary shaft 60 and in turn surrounded by an annular ridge 102 forming a part of the working face of the housing 20. The pocket 100 is in communication with the outlet passage 96.

Radially outside the arcuate inlet port 76 is an arcuate recess 110 in the working face which has a circumferential extent originating at the leading end at 112 at about the same angle displacement as the inlet port 76 and terminating at a trailing end at 114 a little beyond the port 76. An arcuate wall 116 separating port 76 and recess 110 terminates at 118 where it drops into the sweep channel 90.

The shape of the channels 90 and 110 has significance in relation to the efficiency and function of the pump. As shown in FIGS. 1 and 3, the channel 90 increases in depth as it progresses radially outward. This channel can also be deeper at the origin adjacent the point 92 and shallower at the outlet 96 to increase the outlet pressure. The reason for the radial variation in depth lies in the fact that the lineal speed of the rotor (peripheral velocity) varies with the radius. Circumference equals $2\pi r$. The radial variation in the volume capacity of the channel 90 is provided to allow maximum volume and maximum pressure to develop in the sweep.

Figure 6:
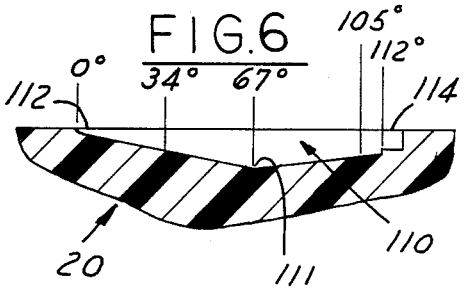
FIG. 6, an enlarged arcuate angle development of the channel configuration.

The arcuate channel 110 also varies radially from a small entrance end 112 to a wide central portion and ensmalling to end 114. The channel 110 also varies in depth from shallowest at 112 to deepest centrally at 111 and again shallowing at the outlet end 114. In FIG. 6, the varying depth of the channel 110 is illustrated. If the origins of the port 76 and channel 110 are located at about 23° to the left of the vertical diameter in FIG. 4 and referenced at 0°, the channel 110 extends circumferentially about 112° as shown in FIGS. 4 and 6. At the deepest part of the channel, the location is 67° or about 90° from the vertical diameter. In a pump in which housing 20 is $1\frac{3}{8}$" in diameter, the channel 110 has a maximum depth of 0.125" and a maximum radial dimension about the same. This channel 110 may be referred to as a spill channel as will be explained in connection with the operation of the pump.

Figure 5:
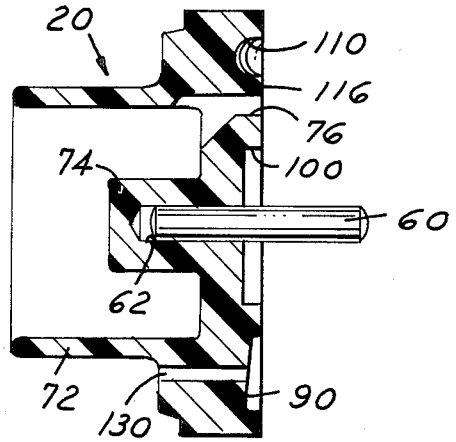
FIG. 5, a sectional view of the inlet housing on line 5—5 of FIG. 2 or FIG. 4.

As shown in FIGS. 2, 4 and 5, a purge port 130 is illustrated penetrating the wall of the housing 20 from the sweep channel 90 to the outside of the housing. The circumferential position of this port is about half-way around the sweep channel 90. This port bleeds off vapor at the start of the pump to allow quick priming. It does not affect the overall efficiency of the pump when liquid fuel is moving in the channel.

Figure 7:
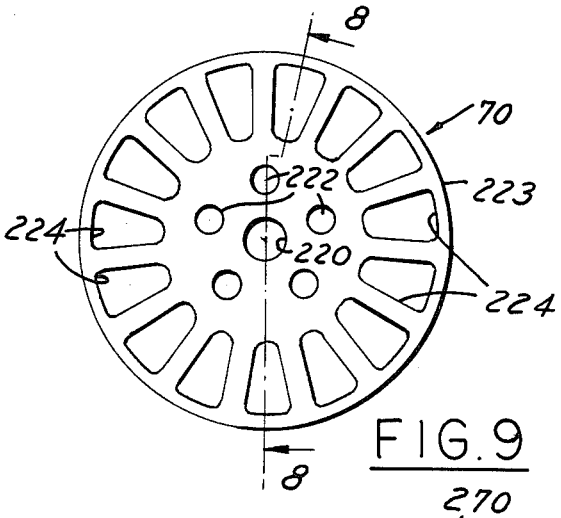
FIG. 7, an elevation of the pump rotor on line 7—7 of FIG. 1.
Figure 8:
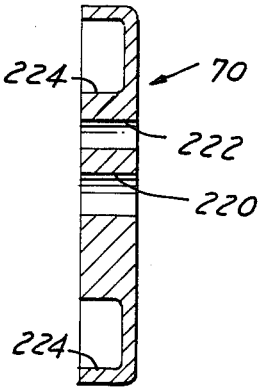
FIG. 8, a sectional view of the pump rotor on line 8—8 of FIG. 7.

The rotor 70 is illustrated in isolation from the assembly in FIGS. 7 and 8. This rotor 70 has a central bore 220 in a solid central section to receive the mounting shaft 60 and circumferentially spaced holes 222 to receive the axially extending drive fingers 64 on the armature projection 50. The rotor 70 has a solid peripheral rim 223 and within this rim are 15 circumferentially spaced pockets 224 open to the operating face of the rotor and closed at the back, in other words, blind pockets. This rotor may be formed as an investment casting in steel or, in some cases, of aluminum or a dense plastic such as Teflon TM. If a metal is used, the running surface may be coated with a low friction plastic and the operating face of the housing 20 may also be coated with a low friction plastic such as Teflon TM. This allows the rotor to be in direct contact with the working face of the inlet housing with zero clearance which greatly increases the efficiency of the pump. The coating greatly reduces the frictional drag of the rotating parts.

OPERATION OF THE PUMP

The lateral channel pump above described and illustrated in the drawings may be characterized as a zero clearance pump. The rotor 70 is urged against the working face of the inlet housing by the spider spring disc 66.

When the pump is started, the inlet housing is immersed in liquid fuel in a fuel tank and the outlet nipple 40 is connected to an engine carburetor or other fuel metering device. The pockets 224 of the rotor 70 will receive fuel from the inlet passage 76 as the rotor moves in rotation. Any vapor in the passages will move out through purge port 130 to return to the tank, and fuel in the pockets will be subject to centrifugal force as it is moved around with the rotor. Pressure will develop in the sweep channel 90 and liquid fuel under pressure will leave the pump through the passage 96 to the armature chamber of the pump and thence to the outlet 40.

It will be noted that the central pocket 100 on the working face of the pump is open to the outlet 96 so that this pocket will be pressurized. Some leakage may occur around drive projections 64 but this will be minimal and such leakage as there may be will pass to the pressurized armature chamber.

As previously mentioned, the sweep chamber 90 has a depth which increases with the radius to accommodate the increasing peripheral velocity of the fuel at the varying radii and also the centrifugal force which moves the fuel outwardly. The circumferential motion of the fuel in the sweep chamber causes a progressive pressure increase as the fuel moves around the chamber 90 to the high pressure zone at the radial outlet 96.

The operation and efficiency of the pump is enhanced by another feature of the operation face in the spill channel 110 shown in FIG. 4. This channel lies outside the arcuate inlet port 76 and is separated by an arcuate wall 116 which terminates at 118 just ahead of the downstream end 114 of the channel 110. The rotating pockets 224 are always full of fuel; and as they pass the ledge 98 of the outlet passage 96, the fuel in the pockets will be pressurized by centrifugal force.

Thus, as the pockets reach the shallow leading end of the channel 110, which may be characterized as a spill channel, the fuel in the pockets will spill into the channel 110 at an increasing rate and, under the influence of the peripheral velocity, move to the deepest part of the channel 110 at 111 and then to the trailing end 114. As this fuel in the spill channel leaves the channel at 114, it is pressurized. Since the overall volume of channel 110 is greater than that of the sweep channel, at the merge zone as the fuel enters the sweep channel, there will be a pressure build-up at 114.

This pressure build-up balances to some degree the pressure at the outlet 96 to stabilize the rotor; but it also allows some fuel to flow black into the inlet port 76 and is recycled to the channel 110. This pressure will compress any vapor back to liquid and will modulate flow from the regular inlet port 76. This pressure at the merge zone, that is, at the leading end of sweep passage 90, reduces turbulance and provides a quiet running pump.

Figure 9:
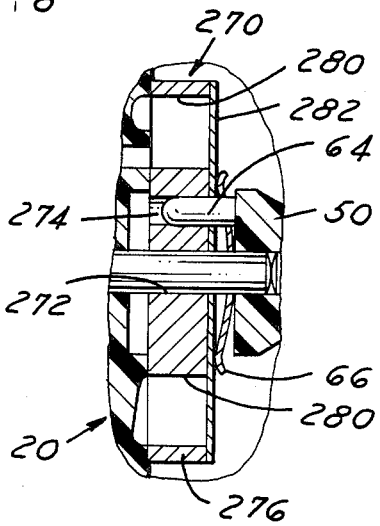
FIG. 9, a sectional view of a rotor showing a modified configuration.

In FIG. 9, a modified rotor 270 is illustrated. This rotor has the solid center with a hold 272 for the mounting pin 60 and the spaced holes 274 for the drive fingers. The rotor 270 has a closed peripheral wall 276 and circumferentially spaced pockets 280 which are open to each side of the rotor. The elevational view of rotor 270 will be the same as in FIG. 7.

This rotor 270 is used in conjunction with a thin, flexible disc 282 which overlies the entire rotor and closes the pockets on the side facing the armature chamber. The usual spider spring 66 can be used to bias the disc toward the rotor. In operation, the rotor would function in the same manner as the rotor 70 in the previous illustrations. However, excess pressure in the pockets 280 would move the periphery of the disc away from the rotor and spill fuel into the armature chamber. This allows the use of a rotor with the pockets extending through the rotor which is much less expensive to manufacture. In some cases, it is possible, when using the flexible disc, to eliminate the radial discharge port 96 and allow full discharge past the periphery of the flexible disc. The elimination of the port 96 would also permit a smaller diameter pump which in some cases is very desirable.

What is claimed is:

1. In a lateral channel pump having an inlet housing with a pumping face in a first plane normal to the axis of rotation and a rotor having a multi-pocketed pumping face to rotate adjacent said housing pumping face, that improvement which comprises:

(a) means forming an arcuate intake passage in said pumping face having a leading and a trailing end extending essentially concentric to the axis of rotation and circumferentially a first predetermined angle of the 360° rotation, (b) a radially extending outlet port in said pumping face spaced circumferentially away from said intake passage a second predetermined angle, and (c) a circumferential sweep channel in said pumping face between the trailing end of said arcuate intake passage and said outlet port having a cross-section enlarging radially from the inner circumference of said channel to the outer circumference of said channel said sweep channel further enlarging in cross-sectional area from said inlet to said outlet.

2. A lateral channel pump as defined in claim 1 in which an arcuate spill channel in said pumping face is disposed radially outwardly of said arcuate intake passage originating at about the leading end of said arcuate intake passage and terminating at a trailing end at said sweep channel, and an arcuate wall separating said intake passage and said spill channel.

3. A lateral channel pump as defined in claim 2 in which the trailing end of said spill channel terminates beyond the trailing end of said arcuate intake passage.

4. A lateral channel pump as defined in claim 1 in which said rotor is mounted on a shaft extending from said pumping face, and a central recess is formed around said shaft open to said outlet port wherein said central recess is pressurized during the operation of said pump.

5. A lateral channel pump as defined in claim 1 in which said rotor has a plurality of circumferentially spaced radial pockets extending axially through said rotor, a flexible disc means overlying a second face of said rotor opposite said pumping face, and means to mount said disc to rotate with said rotor against said second face.

6. In a lateral channel pump having an inlet housing with a pumping face in a first plane normal to the axis of rotation and a rotor having a multi-pocketed pumping face to rotate adjacent said housing pumping face, that improvement which comprises:

(a) means forming an arcuate intake passage in said pumping face having a leading and a trailing end extending essentially concentric to the axis of rotation and circumferentially a first predetermined angle of the 360° rotation, (b) a radially extending outlet port in said pumping face spaced circumferentially away from said intake passage a second predetermined angle, (c) a circumferential sweep channel in said pumping face between the trailing end of said arcuate intake passage and said outlet port having a cross-section enlarging radially from the inner circumference of said channel to the outer circumference of said channel, (d) an arcuate spill channel in said pumping face disposed raidally outwardly of said arcuate intake passage originating at about the leading end of said arcuate intake passage and terminating at a trailing end at said sweep channel, (e) an arcuate wall separating said intake passage and said spill channel, and (f) said spill channel having an axial depth off said pumping face increasing from the leading end to a maximum depth and decreasing toward the trailing end.

7. In a lateral channel pump having an inlet housing with a pumping face in a first plane normal to the axis of rotation and a rotor having a multi-pocketed pumping face to rotate adjacent said housing pumping face, that improvement which comprises:

(a) means forming an arcuate intake passage in said pumping face having a leading and a trailing end extending essentially concentric to the axis of rotation and circumferentially a first predetermined angle of the 360° rotation, (b) a radially extending outlet port in said pumping face spaced circumferentially away from said intake passage a second predetermined angle, (c) a circumferential sweep channel in said pumping face between the trailing end of said arcuate intkae passage and said outlet port having a cross-section enlarging radially from the inner circumference of said channel to the outer circumference of said channel, (d) an arcuate spill channel in said pumping face disposed radially outwardly of said arcuate intake passage originating at about the leading end of said arcuate intake passage and terminating at a trailing end at said sweep channel, (e) an arcuate wall separating said intake passage and said spill channel, and (f) said spill channel having a radial dimension increasing from the leading end to a maximum width about centrally of the arcuate extent of the spill channel and decreasing to the trailing end of the spill channel.

8. In a lateral channel pump having an inlet housing with a pumping face in a first plane normal to the axis of rotation and a rotor having a multi-pocketed pumping face to rotate adjacent said housing pumping face, that improvement which comprises:

(a) means forming an arcuate intake passage in said pumping face having a leading and a trailing end extending essentially concentric to the axis of rotation and circumferentially a first predetermined angle of the 360° rotation, (b) a radially extending outlet port in said pumping face spaced circumferentially away from said intake passage a second predetermined angle, (c) a circumferential sweep channel in said pumping face between the trailing end of said arcuate intake passage and said outlet port having a cross-section enlarging radially from the inner circumference of said channel to the outer circumference of said channel, (d) an arcuate spill channel in said pumping face disposed radially outwardly of said arcuate intake passage originating at about the leading end of said arcuate intake passage and terminating at a trailing end at said sweep channel, (e) an arcuate wall separating said intake passage and said spill channel, and (f) said spill channel having a radial dimension increasing from the leading end to a maximum width about centrally of the arcuate extent of the spill channel and descreasing to the trailing end of the spill channel, and said spill channel having an axial depth off said pumping face increasing from the leading end to a maximum depth and decreasing toward the trailing end.

* * * * *